United States Patent [19]

Rosen

[11] 3,980,376

[45] Sept. 14, 1976

[54] ZERO INSERTION/RETRACTION FORCE CONNECTOR

[75] Inventor: Harold Rosen, Nashua, N.H.

[73] Assignee: Sanders Associates, Inc., Nashua, N.H.

[22] Filed: July 24, 1975

[21] Appl. No.: 599,240

[52] U.S. Cl. ..... 339/75 MP; 339/176; 339/176 MP

[51] Int. Cl.[2] ..... H01R 13/26

[58] Field of Search ..... 339/17, 75, 176, 258

[56] References Cited

UNITED STATES PATENTS

| | | | |
|---|---|---|---|
| 2,802,188 | 8/1957 | Badders | 339/176 MP |
| 3,478,301 | 11/1969 | Conrad et al. | 339/176 MP |

FOREIGN PATENTS OR APPLICATIONS

| | | | |
|---|---|---|---|
| 4,422,981 | 4/1966 | Japan | 339/75 MP |

*Primary Examiner*—Roy Lake
*Assistant Examiner*—E. F. Desmond
*Attorney, Agent, or Firm*—Louis Etlinger; Robert K. Tendler

[57] ABSTRACT

A zero insertion/retraction force connector is disclosed in which a folded spring is mounted in a housing with the folded spring having an arched portion to one side, one end of which serves as a sliding pivot for an extension which curves back towards the arched portion. This extension forms a moveable contact which is deflected towards a conductive stripe on the edge of a printed circuit board when, in one embodiment, a printed circuit board is inserted into the connector such that the bottom of the printed circuit board depresses the arched portion of the spring. Depression of the arched portion causes the sliding pivot to move laterally and rotate such that the extension swings into contact with one side of the printed circuit board and slides upon the conductive stripe in a wiping action while pressing the other side of the board against a vertical wall of the connector to sandwich the printed circuit board between the moveable contact and the wall. The printed circuit board is clamped into place to maintain the contact pressure by the depression of the arched portion. Release of the printed circuit board is accomplished by unclamping the circuit board which permits the upward motion of the printed circuit board and release of the arched portion, with the elasticity of the spring causing the moveable contacts to swing away thereby releasing the printed circuit board.

10 Claims, 6 Drawing Figures

ZERO INSERTION/RETRACTION FORCE CONNECTOR

This invention relates to electrical connectors and more particularly to a zero insertion and retraction force connector.

One of the most important problems associated with multicontact electrical connectors is the problem of the force necessary to cause the mating of the male and female portions of the connector and the separation of these portions. It will be appreciated that if 4–6 ounces of force is required to insert each male member or pin, for connectors of having 50–200 + pins the mating force is indeed considerable. Moreover, and perhaps more importantly, when the connectors are to be separated, a large force is necessary. The subject invention solves this problem by providing that the force applied to a male conductive pin when it is inserted into the connector be zero both during the mating and separation process. This facilitates ease of insertion and removal regardless of the number of pins associated with the connector.

Although the subject invention applies to a wide variety of multipin connectors, one especially noteworthy application is the use of this connector with the edgeboard connectors on printed circuit boards. These boards typically carry 100 or more male connectors on an edge in the form of conductive stripes. The board is typically inserted into an elongated slot in a multicontact female connector mounted on a circuit board which interconnects boards inserted into other female connectors.

Because of the number of connections, there is a considerable amount of resistance to insertion due to frictional force applied when the board is inserted. Likewise there is considerable resistance to removal of the board making removal difficult. The subject connector not only provides for zero insertion and retraction force, but also provides that removal be assisted by providing that a portion of the connector urge the board out of the connector when the board is unclamped.

By way of background, as described in connection with U.S. Pat. No. 3,474,387, prior art connectors generally utilize contacts which are in the form of deflectable simple beams in the female portion of the connector which are deflected into contact with the pins or posts from a mating male connector. The connection of the simple beam is ordinarily accomplished by cams eccentrically mounted relative to the center line of the connector and rotatable about an axis normal to the plane in which the beams are deflectable. One of the main difficulties with the external cam actuated connector is that access to the cam is oftentimes approached from the lengthwise end of the connector instead of being accessible from the same direction in which the force is applied to cause mating of the male and female portions of the connector. In the case of printed circuit boards, what this means is that when the circuit board is inserted it is necessary to actuate the cam from a direction which may be obscurred either by a portion of the cavity in which the circuit board is inserted or by other equipment or electronic components. Thus there is no easy access to the cam actuating member for either camming the deflectible beams into contact with the projecting pins or, for camming them away from the pins in case of removal from the printed circuit board.

One of the solutions available in the prior art to the problem of eliminating the cam is to provide a fixed pivot device such as that illustrated in Japanese Pat. No. 44-22981 filed Apr. 4, 1966 and issued to Nippon Kokudenshi in 1969. In this patent a simple L-shaped element is mounted in the connector housing such that the L-shaped element is provided at its corner when a pin or edgeboard is pressed against a laterally extending portion of the L-shaped member. This causes the pivoting of the remainder of the L-shaped member into contact with the pin or post which is inserted. In a different embodiment an S-shaped member is fixedly pivoted when the pin is inserted. In this embodiment, the pin contacts one end of the S-shaped member to pivot the curved portion into contact with the pin. In a still further embodiment, a folded spring structure is pivoted at a fixed pivot such that a portion of the folded portion of the spring is contacted by the inserted pin or edgeboard with the result that the outer portion of the folded spring is moved into contact with the inserted pin. In all of these embodiments a fixed pivot is used which usually necessitates additional apparatus to anchor the pivot point.

In contrast to the connector illustrated in the above mentioned Japanese patent, the subject invention utilizes a sliding or floating pivot which is moved in a lateral direction by the depression of an arched spring portion, depressed by the insertion of the edgeboard connector or a male connector pin. Attached to the sliding pivot is an extension which is folded backwardly towards the arched portion with the extension carrying a contact portion which moves in a direction opposite to the direction of the sliding pivot to wedge the circuit board or pin between itself and either an opposing side wall of the housing forming part of a channel through which the male connector is inserted, or a fixed contact supported by this wall. The movement of the movable contact is caused by the lateral motion of the pivot and its consequent rotation. In one embodiment, the connector includes two parts: a housing and a spring. In this embodiment the spring is formed with a movable contact portion, the aforementioned arched portion, and is folded upon itself to provide a pin extending exteriorally of the housing. This pin provides electrical access to the moveable contact and an inserted male member which is wedged in the sandwich-like structure after depression of the arched portion. As such the connector assembly is hermaphroditic in that a single unit provides both a male or a female connector. In this connector there is no separate cam actuation which results in simplicity of manufacture and design. In another aspect the connector involves a unitary folded spring configuration such that there are only two parts to the connector, namely the folded spring and the connector housing. This permits single step manufacture, namely the insertion of the spring into the housing. Moreover, the subject connector is compatible with and is designed for current circuit board mounting apparatus in which the edgeboard is clamped into position by virtue of a bar which contacts the top edge of the board and presses it into the connector body. As mentioned hereinbefore, the sliding and rotating pivot requires that there be no anchoring of the pivot point and thus no separate anchor is either necessary or desirable. The approach taken is also useable in single or multiple pin connector embodiments with the same advantages of the edgeboard embodiment. In this latter embodiment the spring may be furnished with a fixed contact portion adjacent the vertical wall opposite the moveable contact portion such that an inserted pin is sandwiched between the moveable and fixed contact portions of the spring. Moreover, in one embodiment, the fixed contact side may be extensive in area to decrease the contact resistance such that a minimum of clamping force provides adequate contact pressure. In a still further embodiment the individual springs may be staggered in opposite directions along the length of the connector housing to accommodate the staggered conductive stripes sometimes found on either side of a printed circuit board.

It is therefore an object of this invention to provide an improved connector.

It is another object of this invention to provide a two-piece zero insertion/retraction force connector utilizing a folded spring and sliding pivot configuration.

It is a further object of this invention to provide a connector having a folded spring and sliding pivot configuration in which male members inserted in the connector experience zero insertion and retraction force and in which contact is made with a wiping action.

It is a still further object of this invention to provide an improved printed circuit board mounting system in which the female connector portion includes a folded spring having an arched portion, a sliding pivot and an extension coupled to the sliding pivot which moves in a direction opposite to that of the sliding pivot when the arched portion is depressed by the insertion of the board.

These and other objects of this invention will be better understood in connection with the following description in view of the appended drawings in which:

DETAILED DESCRIPTION

Figure 1A:
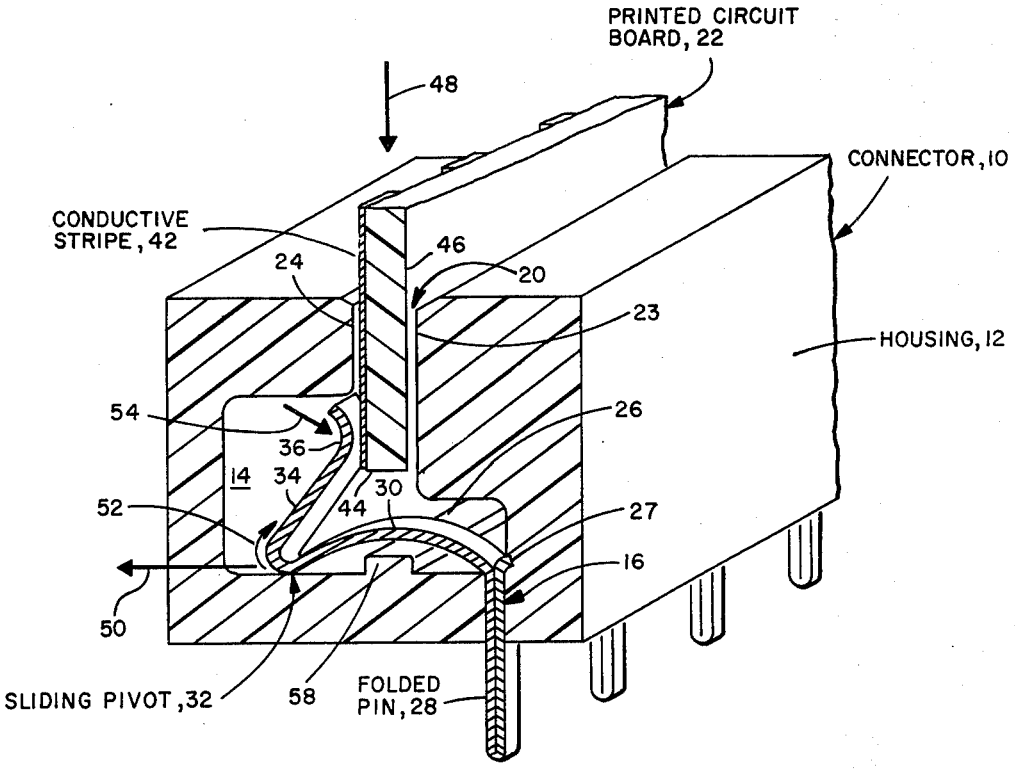
FIGS. 1A and 1B are sectional and diagrammatic illustrations of the subject connector illustrating coaction with an edgeboard connector prior to and after mating.

Referring now to FIG. 1 an edgeboard connector embodiment is illustrated in which a female connector 10 is generally comprised of a housing 12 having a central cavity 14 into which is inserted an electrically conductive folded spring structure 16. The housing has a vertical channel 20 through which the bottom edge of a circuit board 22 may be inserted. Channel 20 is bounded by vertical walls 23 and 24 which position the circuit board during insertion. Beneath wall 23 a portion of the housing is laterally offset as illustrated at 26. Spring 16 starts with a deflectible locking member 27 at one end and depends downwardly through the housing and extends exteriorally of the housing where it is folded as illustrated at 28 to form a folded pin. The upwardly extending portion of the folded pin emerges in cavity 14 and extends leftwardly in an arch 30. This arch 30 may be an arc, may consist of an inverted "V" type structure, or may generally be any type of raised structure. The spring is folded back on itself to form a sliding pivot 32 and an extension 34 which is bent back towards the arch and then extends upwardly to form a moveable contact 36. Mounting of the spring in the housing is accomplished by merely inserting pin 28 through the housing until the arch is in the proper position. During insertion locking member 27 is deflected with its top edge biting into the cavity wall to prevent removal of the pin or dislodging of the entire spring assembly.

The printed circuit board generally illustrated at 22 may be inserted into channel 20 such that a conductive stripe 42 on board 22 is adjacent moveable contact 36 when the board is inserted.

Figure 1B:
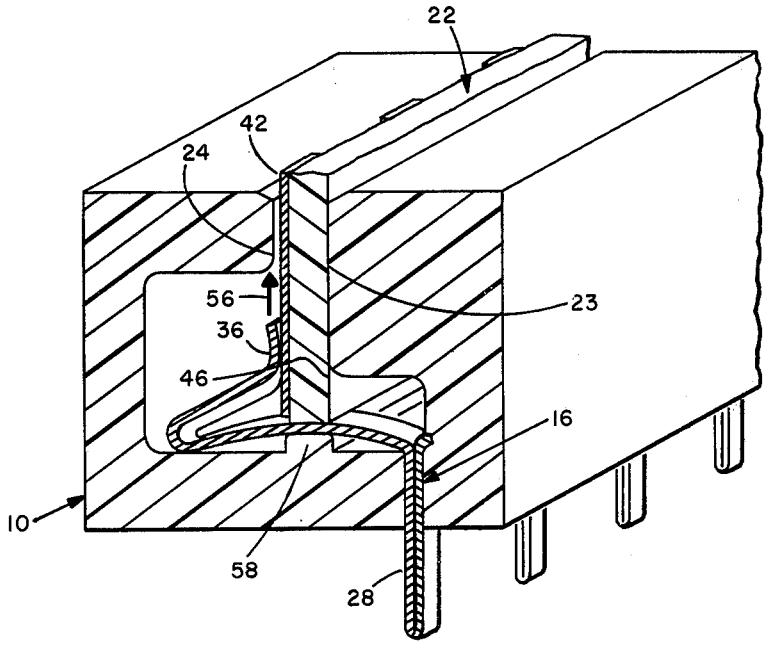

In operation, the printed circuit board is thrust downwardly into the connector as illustrated by arrow 48. The bottom edge 44 of the board depresses the arched portion 30 during last portion of the insertion. This moves pivot 32 in the direction of arrow 50 across a lateral surface of the cavity. The flattening of the arched portion causes pivot 32 to rotate as well translate as illustrated at 52 such that moveable contact 36 is deflected in the direction of arrow 54 to press against conductive stripe 42 on the printed circuit board. This forces the printed circuit board to the right as illustrated in FIG. 1B such that the opposite side 46 of the board is forced into contact with wall 23 thereby sandwiching the circuit board between the moveable contact and a vertical side wall of the insertion channel. As indicated by arrow 56, after the sandwich structure has been formed, continued depression of the arch causes moveable contact 36 to move in the direction of arrow 56 to wipe against stripe 42, thereby providing cleaning action. The downward movement of arch 30 is limited by a stop 58 so that the spring will not break with excessive insertion force.

Figure 2:
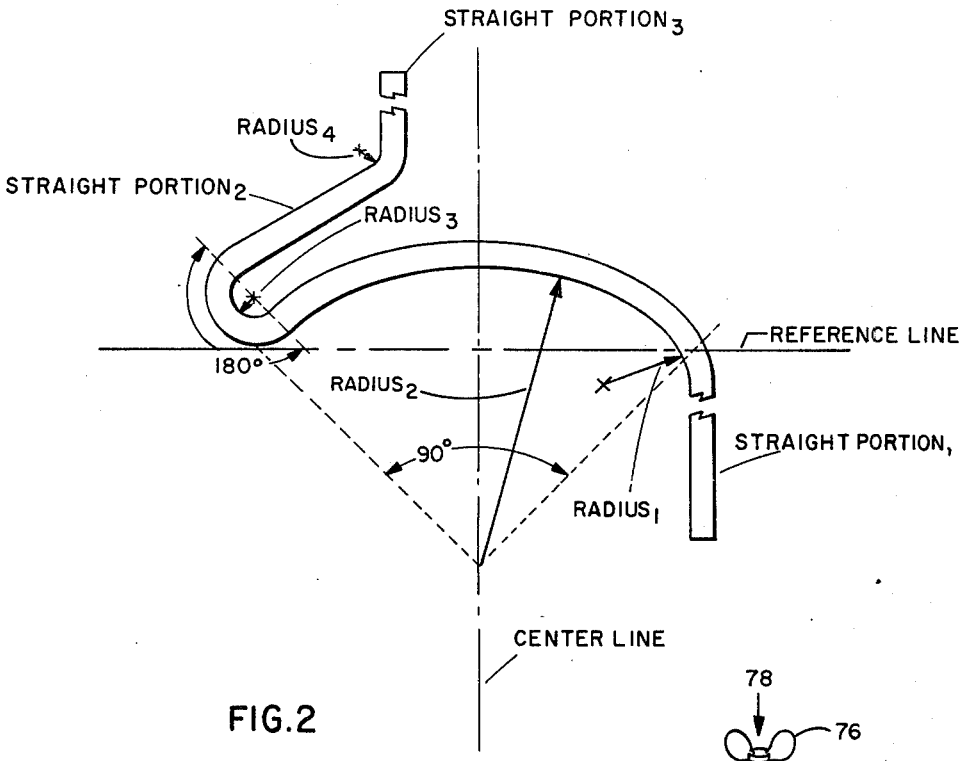
FIG. 2 is a diagrammatic illustration of one spring embodiment.

In one embodiment the spring is made from beryllium-copper which is cold formed to the desired shape. It will be appreciated that the arched portion, sliding pivot portion and the moveable contact portion may be made of any suitable conductive material, the purpose of which is to move the printed circuit board to the right into contact with the opposite wall of the insertion channel. For details of another operative spring configuration in which the spring is configured with radiused and straight sections see FIG. 2. It will be appreciated however, that other configurations are within the scope of this invention and no limitation is intended by the particular configuration in FIG. 2.

Referring back again to FIGS. 1A and 1B it will be appreciated that pin 28 may be replaced with any suitable lead or contact to permit connection of the conductive stripe on the printed circuit board to any other piece of electrical apparatus. The pin is provided so that the connector unit may be mounted on a printed circuit board running perpendicular to the inserted board. Connection between the conductive stripes on the inserted board and other printed circuit boards may be made via connections from the pins on connector 10 to other pins of other connectors. This is illustrated in connection with FIG. 3.

Figure 3:
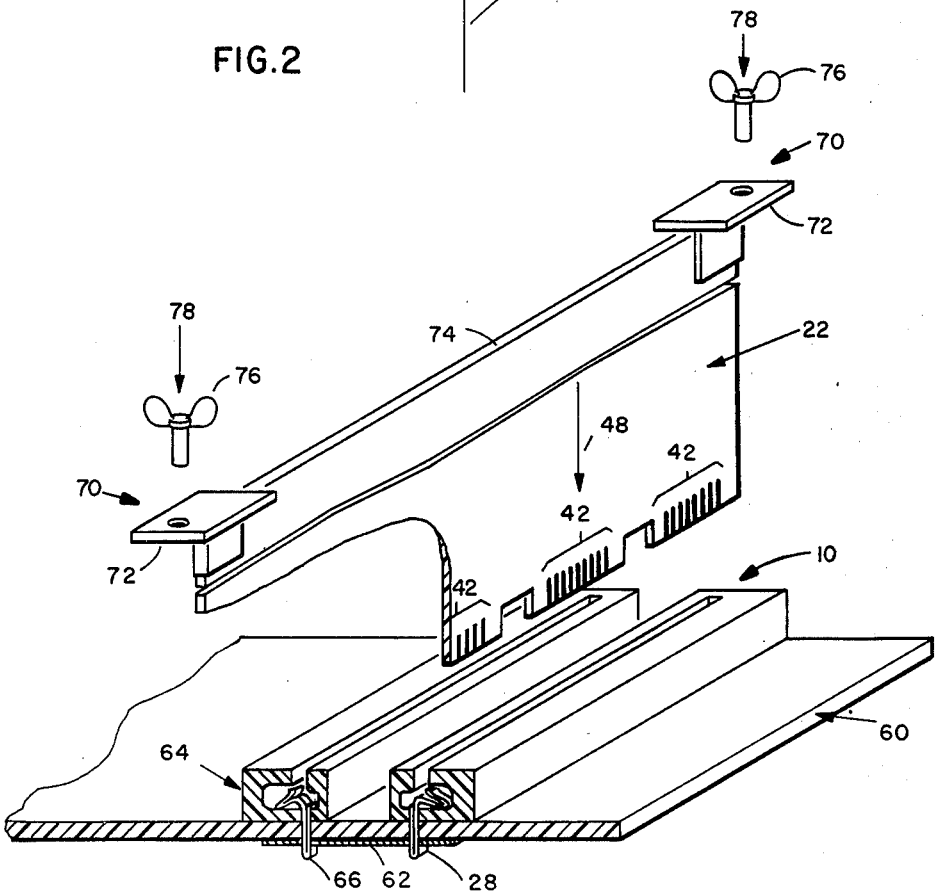
FIG. 3 is a diagrammatic illustration of the mounting of the subject connector on a printed circuit board, the insertion of an edgeboard into the connector carried by the printed circuit board and clamping of the inserted edgeboard connector.

Referring to FIG. 3 printed circuit board 22 having conductive stripes 42 may be inserted into a connector 10 of the type described. This connector is mounted on a horizontal printed circuit board 60 with pin 28 extending through an aperture in the printed circuit board. The pin may then be electrically connected to a patterned conductor 62 on board 60. An additional connector 64 may be provided such that a like pin 66 may protrude through board 60 and be electrically connected to conductor 62. This connects a conductor on printed circuit board 22 via board 60 to connector 64 and thence to an appropriate conductor on a circuit board to be inserted in this connector.

Board 22 may be locked into place after insertion into connector 10 by clamping devices generally indicated by reference character 70 which may include apertured end pieces 72 that fit over the end of a top portion 74 of board 22 to depress the circuit board as indicated by arrow 48 into the connector. These end pieces may be held down by any suitable means such as wing nut assemblies 76 such that force is applied by these nuts as illustrated by arrows 78 to maintain the bottom edge of the printed circuit board depressing the arched portions in the connector. So called "over the center" locking arrangements can also be used for this purpose. It will be appreciated that during initial insertion there are no frictional forces applied to the board. The only force that is applied is that necessary to deform the arched members in the connector. This occurs during the last portion of the insertion cycle thus permitting easy mating and results in the aforementioned cleaning wipe action. Retraction of the board is likewise facilitated by the mere release of end pieces 72. The board is given a gentle upward thrust by the depressed arched members and the board is easily removed because upon release of the arched members the moveable contact swings away from the board thus freeing the board for removal.

Figure 4:
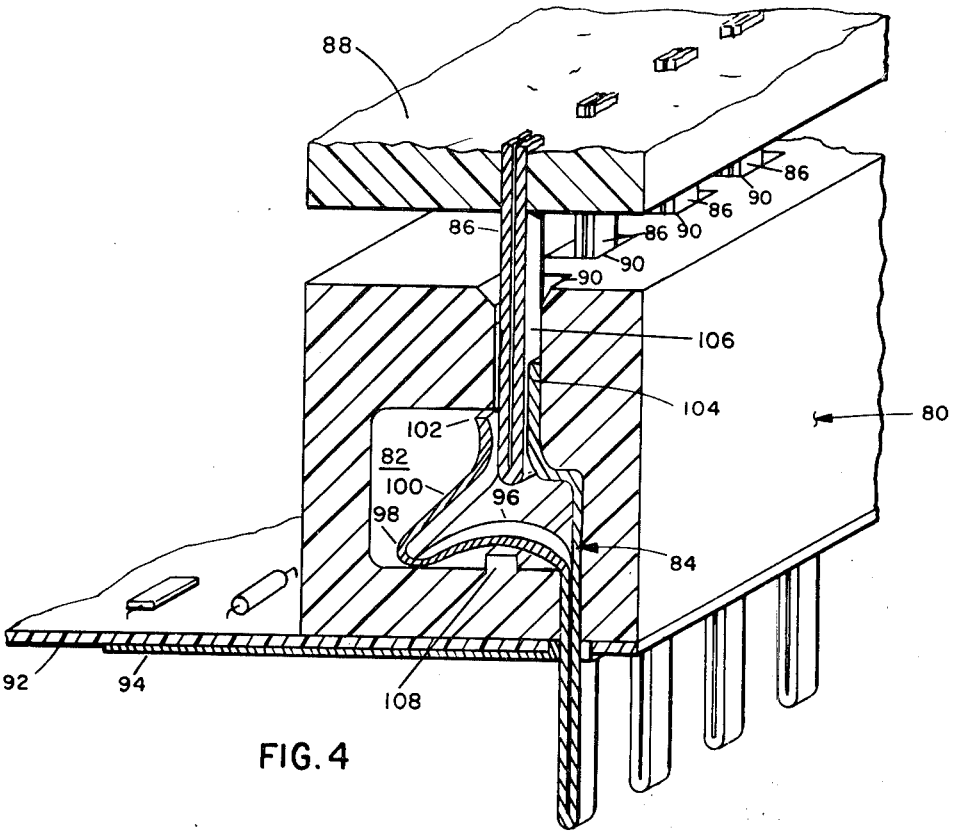
FIG. 4 is a sectional and diagrammatic illustration of the subject connector illustrating mating with pins from a multipin male connector.

While the subject invention may be utilized in the edgeboard configuration just described, the same principle may be utilized with multipin connectors as illustrated in FIG. 4.

Referring now to FIG. 4 a housing 80 having a cavity 82 may be provided with a folded pin connector 84 of the type described hereinbefore. Instead of an edgeboard being inserted into the top portion of the housing, a number of pins 86 from a male connector generally indicated at 88 may be inserted into channels 90 in the top surface of the housing. Both female connector 80 and male connector 88 may be hermaphroditic in the sense that either may take on the configuration of connector 80. Thus only one type connector need be utilized to function either as the male or female connector. Connector 80 may be mounted on a printed circuit board 92, the connection to the circuit board being made by an appropriately patterned conductor 94 carried on the under side thereof.

The operation of the hermaphroditic connector of FIG. 4 is the same as the edgeboard connector of FIG. 3 in that pin 86 depresses an arched portion 96 of the spring connector causing sliding pivot 98 to move to the left thereby causing the bent back extension portion 100 to move in an opposite direction to that of the pivot. A moveable contact 102 at the end of the extension forces pin 86 into contact with a fixed contact 104 which is made integral to the spring and which lies against and extends along a wall 106 of channel 90. It will be appreciated that in this embodiment not only is there a wiping action between pin 86 and moveable contact 102, but also a three point contact is established with pin 86 at contacts 102 and 104 and arch 96. As in the first embodiment a stop 108 limits the depression of arch 96.

Figure 5:
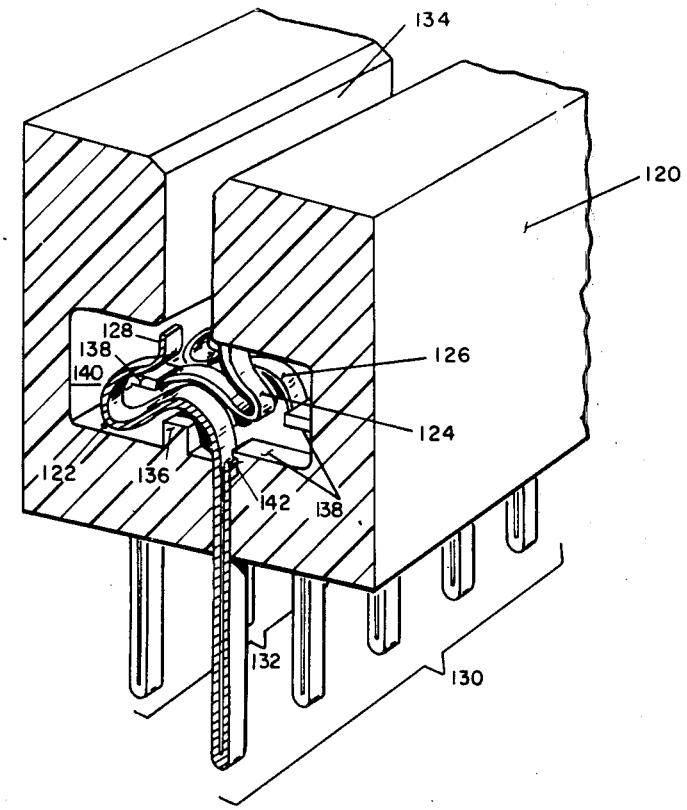
FIG. 5 is a diagrammatic representation of a staggered interleaved arrangement of springs for double sided edgeboard connectors.

In another configuration the subject connector system may be utilized with printed circuit boards having interleaved conductive stripes on either side of the printed circuit board. These stripes are staggered such that on either side of the board they are placed on 100 mil centers with a stripe on one side being spaced from a preceding stripe on another side by 50 mils. A connector to accommodate such a printed circuit board connector arrangement is illustrated in FIG. 5. This connector includes a housing 120 which accommodates individual springs 122, 124, 126 which are staggered along the length of the connector in opposite directions such that moveable contact portions 128 of the springs contact different sides of the inserted printed circuit board. As such the connector is provided with two sets of connector pins 130 and 132 which provide connections to opposite sides of the inserted circuit board respectively. As illustrated the connector housing has a vertical channel 134 for receiving the bottom of the circuit board and a centrally located stop 136 is utilized as described hereinbefore. Additionally, the housing may be provided with extended wall portions 138 adjacent respective ends of individual spring members to provide an anchoring wall when the individual springs are inserted into the central cavity 140 of housing 120, with spring locking portions 142 engaging a vertical section of the extended wall portion. In this manner connections can be made to both sides of an inserted printed circuit board in one simple insertion operation.

It will be appreciated, therefore, that what has been provided is a folded spring contact which is mounted in a housing such that the arched portion is restricted in movement in one direction while a sliding pivot is provided for translation in the opposite direction. The free end of the pivot is provided with an extension having a moving contact portion which moves in an opposite direction to that of the sliding pivot as the pivot rotates to wedge the male contact member which is inserted into the housing between the moveable contact and either a wall or a fixed contact. In this manner contact is made between the inserted male member and the female socket formed by the moveable contact. It will also be appreciated that the connector may be provided with a pin which is formed by folding of the spring on itself thereby to provide an integral mechanically stable structure which will not bend or crumple easily during insertion of this member either into another connector or through a printed circuit board.

Although a specific embodiment to the invention has been described in considerable detail for illustrative purposes, many modifications will occur to those skilled in the art. It is therefore desired that the protection afforded by Letters Patent be limited only by the true scope of the appended claims.

What is claimed is:

1. A connector comprising:

a housing having a cavity and a channel communicating with said cavity;

contact means within said cavity including a contact portion moveable into engagement with a male connector inserted through said channel; and means including sliding and rotating pivot means having a portion positioned to be depressed by the bottom of an inserted male connector for moving said contact means into engagement with said male connector.

2. The connector of claim 1 wherein said means for moving said contact means includes a spring having an arched portion, said sliding and rotating pivot means being at one end of said arched portion, said pivot means being mounted to slide over a surface within said cavity in a direction away from said arched portion and to rotate about itself upon depression of said arched portion, said contact means being connected to said pivot means and moved into engagement with said male connector by the rotation of said pivot means as it slides.

3. The connector of claim 2 wherein said spring is made up of straight portions and radiused portions.

4. A connector comprising:

a housing having a cavity and a channel communicating with said cavity, said channel adapted to receive a male conductor; and a spring contact member mounted in said cavity, said spring contact member having a fixed contact portion, an arched portion anchored at one end and disposed adjacent said channel, a sliding pivot portion at the end of said arched portion away from said anchored end, said pivot portion adapted to slide against a portion of said cavity, and a moveable contact portion fixedly attached to said sliding pivot portion, oriented back towards said arched portion and adapted to move in a direction opposite to the movement of said sliding pivot portion to engage said male conductor when it is inserted, depression of said arched portion by the insertion of said male conductor causing movement of said pivot portion away from said anchored end and rotation of said pivot portion, rotation of said pivot portion forcing said moveable contact portion into mating engagement with said male conductor.

5. The connector of claim 4 wherein said spring contact member includes a folded portion to form a pin extending from said cavity to the exterior of said housing.

6. The connector of claim 5 wherein said folded spring portion is attached to said anchored end and said fixed contact portion.

7. The connector of claim 6 wherein said spring contact member is of unitary construction.

8. In combination:

a printed circuit board having male edge connectors along one edge thereof;

a connector comprising a housing having a cavity and a channel communicating with said cavity adapted to receive the edge of said printed circuit board carrying said male edge connectors, a plurality of contact means with said cavity, each including a contact portion moveable into engagement with an associated male edge connector carried by said printed circuit board and a plurality of means, each including sliding and rotating pivot means having a portion positioned to be depressed by said printed circuit board edge for moving an associated moveable contact portion into engagement with an associated male edge connector; and means for clamping said printed circuit board in said connector such that said arched portions are depressed.

9. The combination of claim 8 wherein each of said means for moving a moveable contact portion includes a spring having an arched portion, said sliding and rotating pivot means being at one end of an associated arched portion, said pivot means being mounted to slide over a surface within said cavity in a direction away from the arched portion, each of said moveable contact portions being connected to an associated pivot means and moved into engagement with an associated male edge connector by the rotation of the associated pivot means as it slides.

10. The combination of claim 8 wherein the male connectors on said printed circuit board include conductive stripes carried in staggered fashion on opposite sides of said printed circuit board and wherein said contact means are likewise staggered in opposite directions within said housing along the length thereof, such that a moveable contact portion mounted in one direction moves into engagement with a conductive stripe on one side of said printed circuit board and such that a moveable contact portion mounted in an opposite direction moves into engagement with a conductive stripe on the other side of said printed circuit board.

* * * * *

UNITED STATES PATENT OFFICE

CERTIFICATE OF CORRECTION

Patent No. 3,980,376 Dated September 14, 1976

Inventor(s) Harold Rosen

It is certified that error appears in the above-identified patent and that said Letters Patent are hereby corrected as shown below:

Column 2, line 7, change "provided" to read -- pivoted --.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*